US005492323A

United States Patent [19]

Lee

[11] Patent Number: 5,492,323

[45] Date of Patent: Feb. 20, 1996

[54] BALL SUPPORT SPECIALLY DESIGNED FOR GOLF PRACTICE

[76] Inventor: Chih-Ping Lee, No. 3, Lane 37, Yen Chiu Yuan Road, Sec. 2, Taipei, Taiwan

[21] Appl. No.: 341,212

[22] Filed: Dec. 5, 1994

[51] Int. Cl.[6] ..... A63B 57/00

[52] U.S. Cl. ..... 273/32.5; 273/33; 273/32 B

[58] Field of Search ..... 273/33, 201, 32.5, 273/203

[56] References Cited

U.S. PATENT DOCUMENTS

| | | | |
|---|---|---|---|
| 4,905,999 | 3/1990 | Voinouich et al. | 273/33 |
| 5,156,403 | 10/1992 | Martino | 273/33 |
| 5,259,622 | 11/1993 | Irving | 273/33 |

*Primary Examiner*—Vincent Millin
*Assistant Examiner*—Charles W. Anderson
*Attorney, Agent, or Firm*—Pro-Techtor International

[57] ABSTRACT

Disclosed is a ball support specially designed for golf practice, which mainly consists of a disk-like base and a ball holder associated with the base. The base is preferably made of rubber material and has a substantially conic top surface and a central through hole with downward expanded lower portion. The ball holder is also preferably made of rubber material and has a seat having a configuration corresponding to that of the central through hole of the base such that the ball holder may be fitly received in the base. The ball holder further has an inwardly curved and reduced waist portion and a top portion above the waist portion for holding a ball thereon. The top portion of the ball holder has a central semi-spherical recess and a further reduced hole formed on a bottom of the semi-spherical recess. With these arrangements, the club, the ball holder, and/or the disk-like base are not easily damaged due to incorrectly swung club during the practice.

8 Claims, 4 Drawing Sheets

BALL SUPPORT SPECIALLY DESIGNED FOR GOLF PRACTICE

BACKGROUND OF THE INVENTION

1. Field of the Invention

The present invention relates to a ball support specially designed for golf practice, and more particularly to a ball support provided with a base such that a green golfer may swing the club in the practice in a more convenient and free manner without the risk of damaging the club, ball support or the base when the swung club carelessly hits at the support or the base thereof.

2. Description of Prior Art

Golf has recently become a very popular game and leisure activity in the world. The population of golfers in Taiwan has dramatically increased following the prosperous economic development and largely upgrade of living standards in this area. However, since it is very expensive to play golf in the golf course and most golfers need to take a long time to practice hard before becoming a skilled player, golf practice yards are conveniently constructed here and there.

In a common golf practice yard, a player may control one of the ball service units 1 so that golf balls 11 are served one by one to a ball support 12 as shown in FIG. 1. The ball support 12 has a circular plate-like top 13 and is inserted down into a stretch of imitative grass 14 which may be, for example, made of plastic. The player stands on a predetermined spot to swing the club to practice the strike of balls. Following shortcomings are existing in the above conventional ball support for golf practice:

a. The ball support has a circular plate-like top and there shall be a large contact area between the circular top and the ball supported thereon, as a result of which, it is not easy for the player to well control the club head for a correct striking position. That is, the player tends to miss the ball and hits against and damages the ball support.

b. The ball support is inserted into the imitative plastic grass and is easily damaged and/or separated from the plastic grass when the ball support is carelessly hit by the player with the club. At this point, the player has to insert the ball support again before returning to his/her striking position which causes many inconvenience to the player during the practice.

c. Since a green player often fails to well control the correct position for his/her club head and the ball support is simply inserted into the plastic grass with its pointed bottom end, the plastic grass is easily damaged by the club which unexpectedly hits against the plastic grass, forming another high cost to the player.

d. The ball is usually placed at different heights depending on the player's preference. However, the ball supports provided in the common golf practice yards usually have fixed height and therefore, can not give the players the same feeling as that of playing golf on a real golf course.

SUMMARY OF THE INVENTION

It is therefore a primary object of the present invention to provide a ball support specially designed for golf practice, which generally consists of a disk-like base and a ball holder associated with the base. The disk-like base is fixed onto the ground in such a way that it is not easily separated from the ground even when it is hit by the player with the club.

Another object of the present invention is to provide the above described ball support for golf practice in which both the base and the ball holder are made of impact-resistant and resilient rubber. The disk-like base has a substantially conic top surface to largely reduce the impact force of a club head against the base and thereby prolongs the usable life of the base.

A further object of the present invention is to provide the above described ball support for golf practice in which the ball holder has an inwardly curved and reduced waist portion and a top portion for holding a ball thereon. The reduced and curved waist portion of the ball holder provides better flexibility and impact-resistance while the top portion is so formed that there is only a small contact area between the top portion and the ball supported thereon, giving the player the same feeling as that of playing on a real golf course.

A still further object of the present invention is to provide the above described ball support for golf practice in which the ball holder is designed to have various heights for convenient change and association with the base, and thereby best gives the player the feeling of playing on a real golf course.

BRIEF DESCRIPTION OF THE DRAWINGS

The detailed structure, principles applied, and functions of the present invention may be best understood through the following detailed description of the preferred embodiments and the accompanying drawings wherein.

DETAILED DESCRIPTION OF THE PREFERRED EMBODIMENTS

Figure 1:
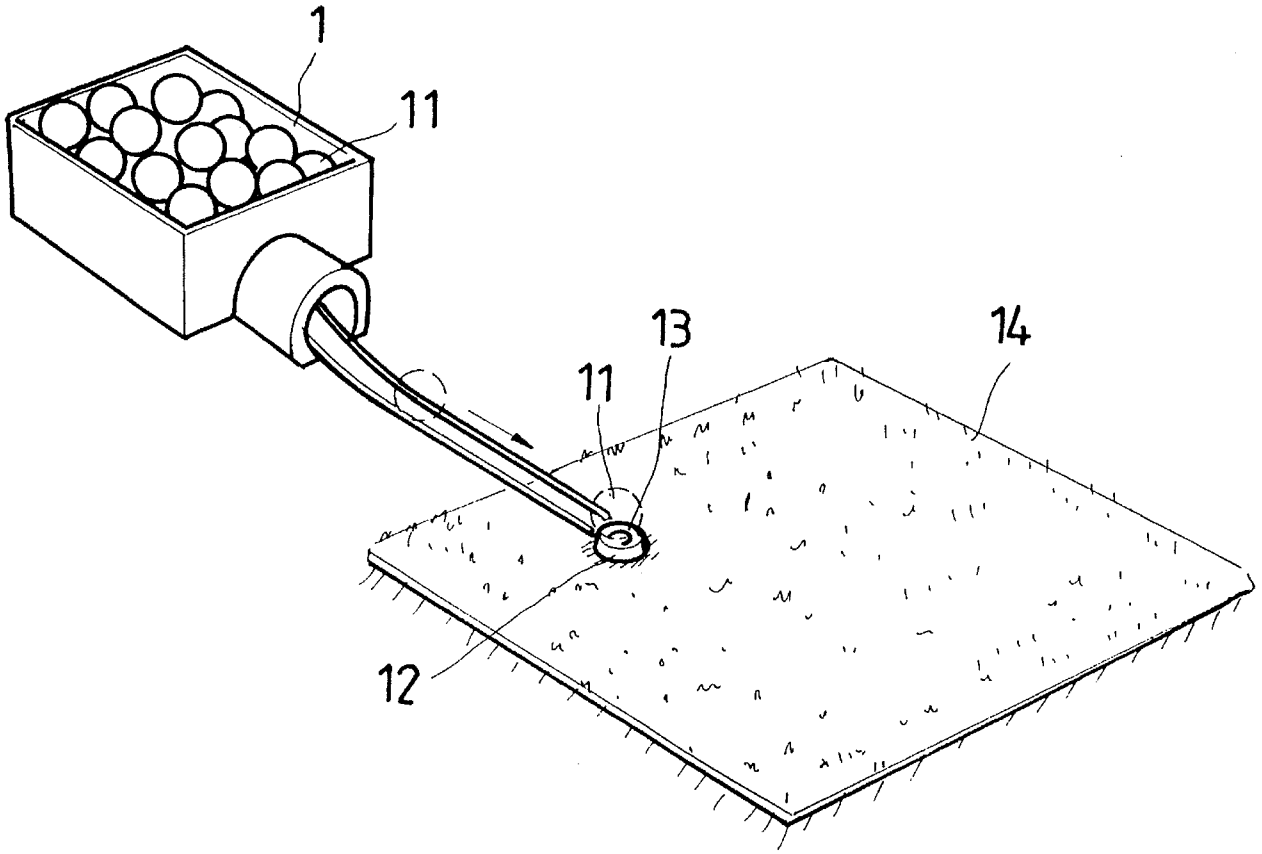
FIG.1 (PRIOR ART)
FIG. 1 illustrates a conventional ball support for golf practice.
Figure 2:
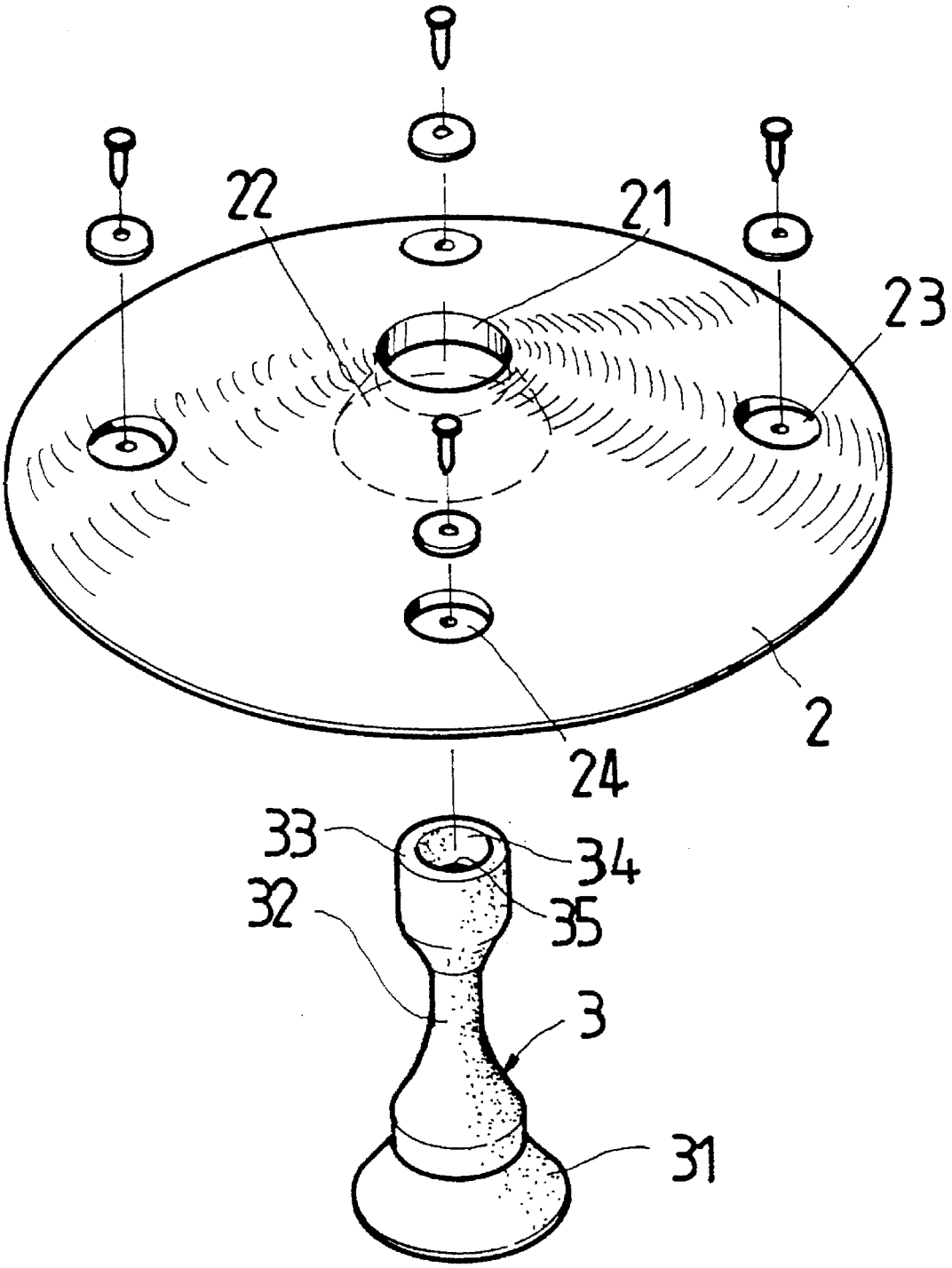
FIG. 2 is a disassembled perspective of a first embodiment of the ball support for golf practice according to the present invention.

Please refer to FIG. 2. A ball support for golf practice according to the present invention mainly consists of a disk-like base 2 and a ball holder 3. The base 2 is preferably made of rubber material and has a substantially conic top surface and a flat bottom surface. A through hole 21 having a downward expanded lower portion 22 is formed on the center of the base 2. Suitable numbers of fixing holes 23, 24 are properly provided on the base 2 for fixedly positioning the latter on the ground at a predetermined point. The ball holder 3 is also preferably made of rubber material and has a seat 31 which is so configured that it can be fitly received in the through hole 21 and the downward expanded lower portion 22 of the through hole 21 to allow firm engagement of the ball holder 3 with the base 2. The ball holder 3 further has an inwardly curved and reduced waist portion 32 forming a middle section thereof, and a top portion 33 for holding a ball thereon. The top portion 33 is formed with a central semi-spherical recess 34 and an internal downward reduced hole 35 formed at a bottom center of the recess 34, such that a ball 5 supported by the ball holder 3 contacts the latter only at an annular top edge of the top portion 33.

Figure 3:
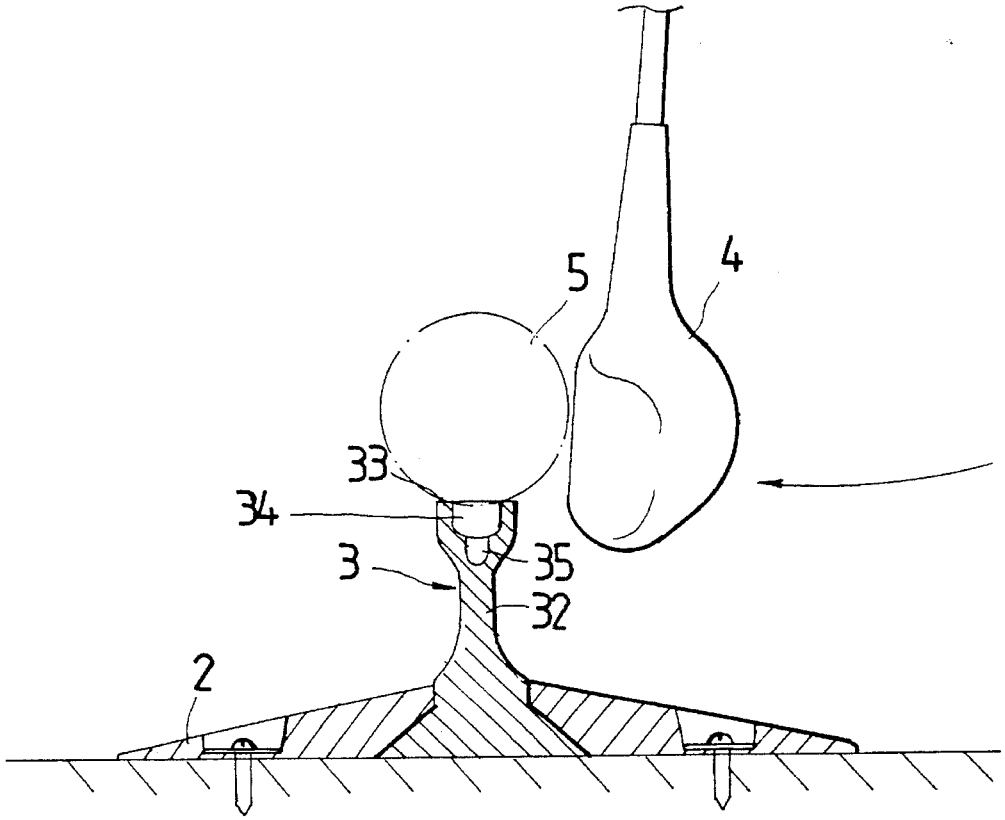
FIG. 3 is a sectional view showing the assembled ball support of FIG. 2, with a ball supported thereon to show the use thereof.

Moreover, as shown in FIG. 3, after the ball holder 3 and the base 2 are assembled together, the base 2 may be fixed to the ground of a practice yard by means of nails or the like. The substantially conic top surface of the base 2 forms a good guide surface for a club 4 to weaken its swinging force when a head portion thereof carelessly hits against the base 2. In addition, the rubber material used in the present invention also provides high wear resistance and proper resilience and flexibility to prevent the club 4 and disk-like base 2 from being easily damaged when the latter is hit by the former. Moreover, as shown in the figures, the inward curved and reduced waist portion 32 of the ball holder 3 gives the latter higher toughness and flexibility to sustain any impact on it. Meanwhile, since the ball 5 contacts the top portion 33 of the ball holder 3 only at the annular top edge thereof, the player may swing the club 4 and hit the ball 5 more easily. With the specially designed reduced waist portion 33, the ball holder 3 may have increased toughness and flexibility to avoid being easily damaged by a heavily swung club 4 and/or easily separated from the disk-like base 2. And, the assembled base 2 and ball holder 3 integrally gives the player the same feeling as that will be perceived by the player on a real golf course when swinging a club 4 to strike a ball 5.

Figure 4:
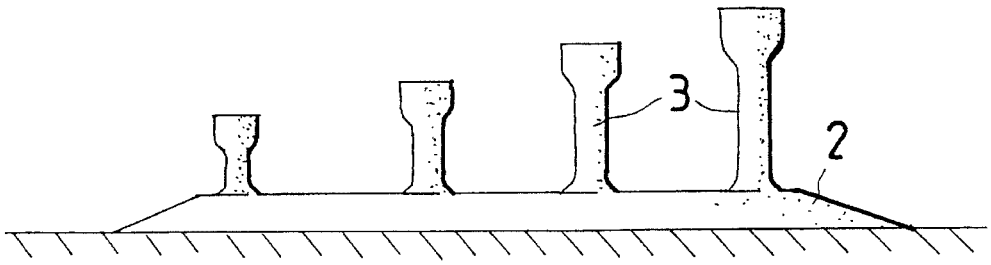
FIG. 4 illustrates a second embodiment of the present invention.

FIG. 4 illustrates a second embodiment of the present invention in which a plurality of ball holders 3 separately in different heights are integrally formed with the disk-like base 2 to provide the users one more alternative.

Figure 5:
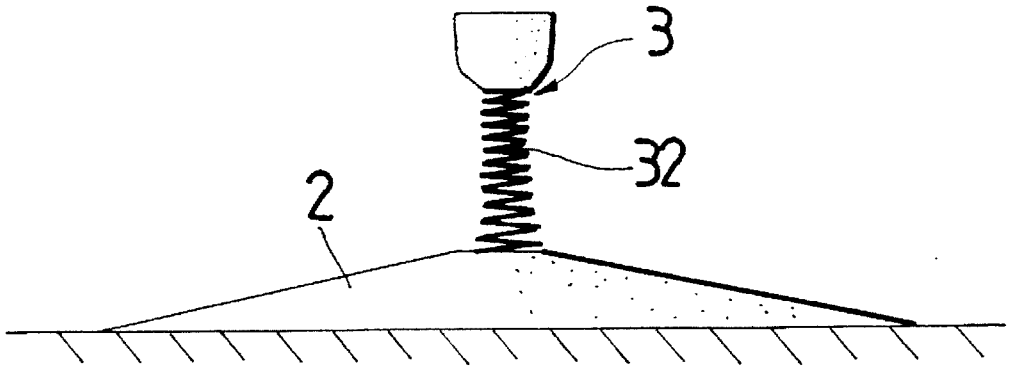
FIG. 5 illustrates a third embodiment of the present invention.

FIG. 5 illustrates a third embodiment of the present invention in which the ball holder 3 has a waist portion 32 in the form of a spring so as to provide the ball holder 3 with increased resiliency.

Figure 6:
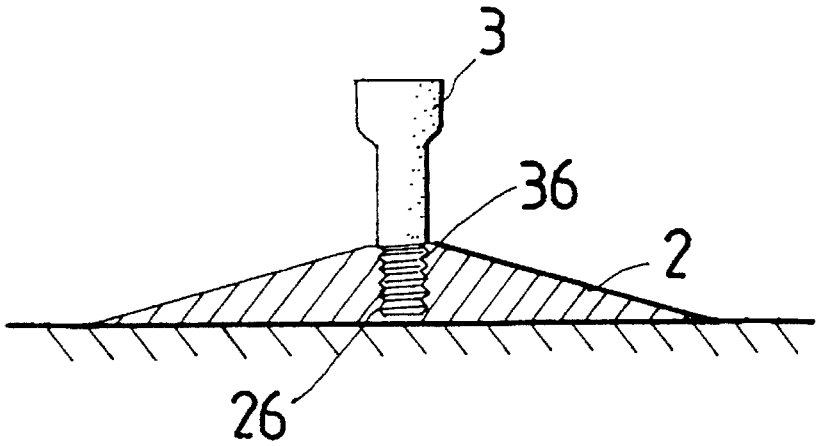
FIG. 6 illustrates a fourth embodiment of the present invention.

Please refer to FIG. 6 for a fourth embodiment of the present invention in which the ball holder 3 is provided on its seat with external threads 36, and the disk-like base 2 is provided on its central through hole 21 with internal threads 26 corresponding to the external threads 36. With this arrangement, the ball holder 3 can be adjusted in height relative to the base 2 after it has been assembled with the base 2, so that the ball support may satisfy users with different striking height preference.

According to the above arrangements, the ball support specially designed for golf practice according to the present invention not only allows a user to swing the club and strike the ball conveniently but also protects itself as well as the club and the disk-like base from being easily damaged by an incorrectly swung club.

The above embodiments are only used for illustration and are not intended to limit the scope of the present invention. Many modifications of these embodiments can be made without departing from the spirit of the present invention.

What is claimed is:

1. A ball support for golf practice comprising:

a disk-like base, and a ball holder associated with said base;

said base includes a substantially conic top surface, a central through hole, and fixing holes to receive means to secure said base at a given position, said central through hole includes an outward tapered lower portion, such that an upper end of said lower portion has a diameter equal to a diameter of said through hole at a top surface of said base, the diameter of said through hole increasing to a maximum at a lower end thereof, and said ball holder includes a seat configured so that it is securely received in said central through hole, a base of said ball holder has a profile matching that of said central through hole so that said ball holder is inserted into said through hole from an underside of said base, said seat of said ball holder securing said ball holder in said base.

2. The ball support of claim 1 wherein:

said base and said ball holder are made of rubber.

3. The ball support of claim 1 wherein:

said top portion of said ball holder has a central semi-spherical recess so that a ball supported on said ball holder contacts said ball holder only at an annular top edge of said top portion.

4. The ball support of claim 1 wherein:

a central portion of said ball holder is a spring.

5. The ball support of claim 1 wherein:

said seat of said ball holder includes external threads and said central through hole includes corresponding internal threads such that a user can adjust, without the use of tools, the height of said ball holder after assembly of said ball support.

6. A ball support for golf practice comprising:

a disk-like base with an integral ball holder protruding from a top surface thereof, said base includes a substantially conic top surface and fixing holes to receive means to secure said base at a given position, and said ball holder includes a central semi-spherical recess so that a ball supported on said ball holder contacts said ball holder only at an annular top edge of said top portion.

7. The ball support of claim 6 wherein:

said ball support is made of rubber.

8. The ball support of claim 6 wherein:

a central portion of said ball holder is a spring.

* * * * *